US008414357B2

(12) United States Patent
Wang et al.

(10) Patent No.: US 8,414,357 B2
(45) Date of Patent: Apr. 9, 2013

(54) CHEMICAL MECHANICAL POLISHER HAVING MOVABLE SLURRY DISPENSERS AND METHOD

(75) Inventors: Yulin Wang, Sunnyvale, CA (US); Alpay Yilmaz, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 1249 days.

(21) Appl. No.: 12/196,860

(22) Filed: Aug. 22, 2008

(65) Prior Publication Data

US 2010/0048106 A1 Feb. 25, 2010

(51) Int. Cl.
*B24B 7/22* (2006.01)

(52) U.S. Cl. ..... 451/41; 451/460

(58) Field of Classification Search ..... 451/287, 451/288, 289, 290, 5, 446, 60, 41
See application file for complete search history.

(56) References Cited

U.S. PATENT DOCUMENTS

| | | | | |
|---|---|---|---|---|
| 4,991,529 | A | 2/1991 | McKune et al. | |
| 5,709,593 | A | 1/1998 | Guthrie et al. | |
| 5,964,413 | A | 10/1999 | Mok | |
| 6,053,801 | A | 4/2000 | Pinson et al. | |
| 6,098,901 | A | 8/2000 | Mok | |
| 6,139,406 | A | 10/2000 | Kennedy et al. | |
| 6,152,806 | A | 11/2000 | Nystrom | |
| 6,179,690 | B1 | 1/2001 | Talieh | |
| 6,196,900 | B1 | 3/2001 | Zhang et al. | |
| 6,206,760 | B1 | 3/2001 | Chang et al. | |
| 6,220,941 | B1 | 4/2001 | Fishkin et al. | |
| 6,251,001 | B1 | 6/2001 | Pinson et al. | |
| 6,280,299 | B1 | 8/2001 | Kennedy et al. | |
| 6,283,840 | B1 * | 9/2001 | Huey | 451/288 |
| 6,284,092 | B1 | 9/2001 | Manfredi | |
| 6,336,850 | B1 | 1/2002 | Wada et al. | |
| 6,347,650 | B1 | 2/2002 | Affleck et al. | |
| 6,390,902 | B1 * | 5/2002 | Chang et al. | 451/285 |
| 6,398,627 | B1 | 6/2002 | Chiou et al. | |
| 6,482,290 | B1 * | 11/2002 | Cheng et al. | 156/345.12 |
| 6,623,341 | B2 | 9/2003 | Tolles | |
| 6,626,744 | B1 | 9/2003 | White et al. | |
| 6,685,796 | B1 | 2/2004 | Lin et al. | |

(Continued)

FOREIGN PATENT DOCUMENTS

| | | |
|---|---|---|
| WO | WO-9951398 | 10/1999 |
| WO | WO-2007024807 | 3/2007 |
| WO | WO-2009127932 | 10/2009 |

OTHER PUBLICATIONS

ISA/KR (KIPO), International Search Report & Written Opinion of the International Searching Authority, PCT Appl. No. PCT/US2009/004667 ("Chemical Mechanical Polisher Having Movable Slurry Dispensers and Method"), Mar. 31, 2010 (KR).

*Primary Examiner* — Robert Rose
(74) *Attorney, Agent, or Firm* — Ashok K. Janah; Janah & Associates P.C.

(57) ABSTRACT

A chemical mechanical polisher comprises a polishing platen capable of supporting a polishing pad, and first and second substrate carriers that are each capable of holding a substrate against the polishing pad. First and second slurry dispensers, each comprise (i) an arm comprising a pivoting end and a distal end, (ii) at least one slurry dispensing nozzle on the distal end, and (iii) a dispenser drive capable of rotating the arm about the pivoting end to swing the slurry dispensing nozzle at the distal end to dispense slurry across the polishing platen.

26 Claims, 6 Drawing Sheets

U.S. PATENT DOCUMENTS 6,699,356 B2 3/2004 Bachrach et al.
6,722,943 B2 * 4/2004 Joslyn ..... 451/5
6,824,455 B2 11/2004 Osterheld et al.
6,921,317 B2 7/2005 Wood et al.
6,935,926 B2 8/2005 Brunelli
6,939,210 B2 * 9/2005 Polyak et al. ..... 451/60
6,945,857 B1 9/2005 Doan et al.
7,037,854 B2 5/2006 Bachrach et al.
7,052,374 B1 * 5/2006 Lu et al. ..... 451/60
7,066,795 B2 6/2006 Balagani et al.
7,182,677 B2 2/2007 Donohue et al.
2002/0086619 A1 7/2002 Tolles
2002/0164928 A1 11/2002 Tolles
2006/0003671 A1 * 1/2006 Stumpf et al. ..... 451/5
2006/0201532 A1 9/2006 Shirazi
2007/0042680 A1 2/2007 Benvegnu

* cited by examiner

CHEMICAL MECHANICAL POLISHER HAVING MOVABLE SLURRY DISPENSERS AND METHOD

BACKGROUND

Embodiments of the present invention relate to a chemical mechanical polisher having movable slurry dispensers and related methods.

In the fabrication of the integrated circuits (ICs) and displays, chemical-mechanical planarization (CMP) is used to smoothen the surface topography of a substrate for subsequent etching and deposition processes. A typical CMP polisher comprises a polishing head that oscillates and presses a substrate against a polishing pad while a slurry of abrasive particles is supplied to the polishing pad to polish the substrate. CMP can be used to planarize dielectric layers, deep or shallow trenches filled with polysilicon or silicon oxide, and metal films. It is believed that CMP polishing is a result of both chemical and mechanical effects, for example, a chemically altered layer is repeatedly formed at the surface of the material being polished and then polished away. For example, in metal polishing, a metal oxide layer can be formed and removed repeatedly from the surface of the metal layer during CMP polishing. In oxide polishing, the oxide layer is both chemically and physically eroded by the polishing slurry.

One type of conventional slurry dispenser comprises a fixed arm having a single slurry dispensing nozzle which releases slurry from a fixed point above the polishing pad. The slurry spreads across the polishing pad from the rotary or oscillating motion of the polishing pad and/or substrate carrier. However, because the slurry is dispensed from a single position above the platen, which is often at a mid-point of the radius of the platen, the resultant distribution of slurry across the surface of the platen is not always very uniform. Rotation of the underlying polishing platen and the resultant centrifugal forces causes the slurry to spread radially outward from the median point. However, a preferentially higher concentration of slurry forms in a circular strip that radiates outward from the median dispensing point due to these centrifugal forces, and a lower slurry concentration region forms between the point of dispensation and the radially inner region. This can result in uneven polishing rates across the diameter of the substrate being polished.

Multipoint slurry dispensers also been developed to provide a more uniform distribution of slurry for polishing single substrates, as for example, described in U.S. Pat. No. 6,284,092, entitled "CMP Slurry Atomization Slurry Dispense System". A sweeping multipoint slurry dispenser has also been used to spread the slurry across the pad, as for example, described in U.S. Pat. No. 7,052,374, entitled "Multipurpose Slurry Delivery Arm for Chemical Mechanical Polishing". However, while these slurry dispensing systems provide a better slurry distribution for single substrate polishers, they do not provide effective slurry distribution for newer generations of CMP polishers which use multiple carrier heads to polish several substrates at the same time or which are used for polishing large substrates. Thus it is desirable to have a chemical mechanical polisher with a slurry dispensing system that provides a more uniform distribution of slurry across the surface of the polishing pad for simultaneously polishing multiple substrates or for polishing large substrates.

SUMMARY

A chemical mechanical polisher comprises a polishing platen capable of supporting a polishing pad, first and second substrate carriers that are each capable of holding a substrate against the polishing pad, and first and second slurry dispensers. First and second slurry dispensers each comprise (i) an arm comprising a pivoting end and a distal end, (ii) at least one slurry dispensing nozzle on the distal end, and (iii) a dispenser drive capable of rotating the arm about the pivoting end to swing the slurry dispensing nozzle at the distal end to dispense slurry across the polishing platen.

A chemical mechanical polishing method comprises rubbing first and second substrates against a polishing pad, and dispensing polishing slurry before each of the first and second substrates.

DRAWINGS

These features, aspects and advantages of the present invention will become better understood with regard to the following description, appended claims, and accompanying drawings, which illustrate examples of the invention. However, it is to be understood that each of the features can be used in the invention in general, not merely in the context of the particular drawings, and the invention includes any combination of these features, where:

DESCRIPTION

A chemical mechanical polisher 100 is useful for polishing a surface of a substrate. For example, the polisher 100 can be used to polish a surface of a substrate that comprises copper interconnect lines or vias. In another application, the polisher can be used to polish a surface of a silicon dioxide layer on a substrate. Many other polishing applications and uses, as would be apparent to those of ordinary skill in the art, are also within the scope of the present invention.

Figure 1:
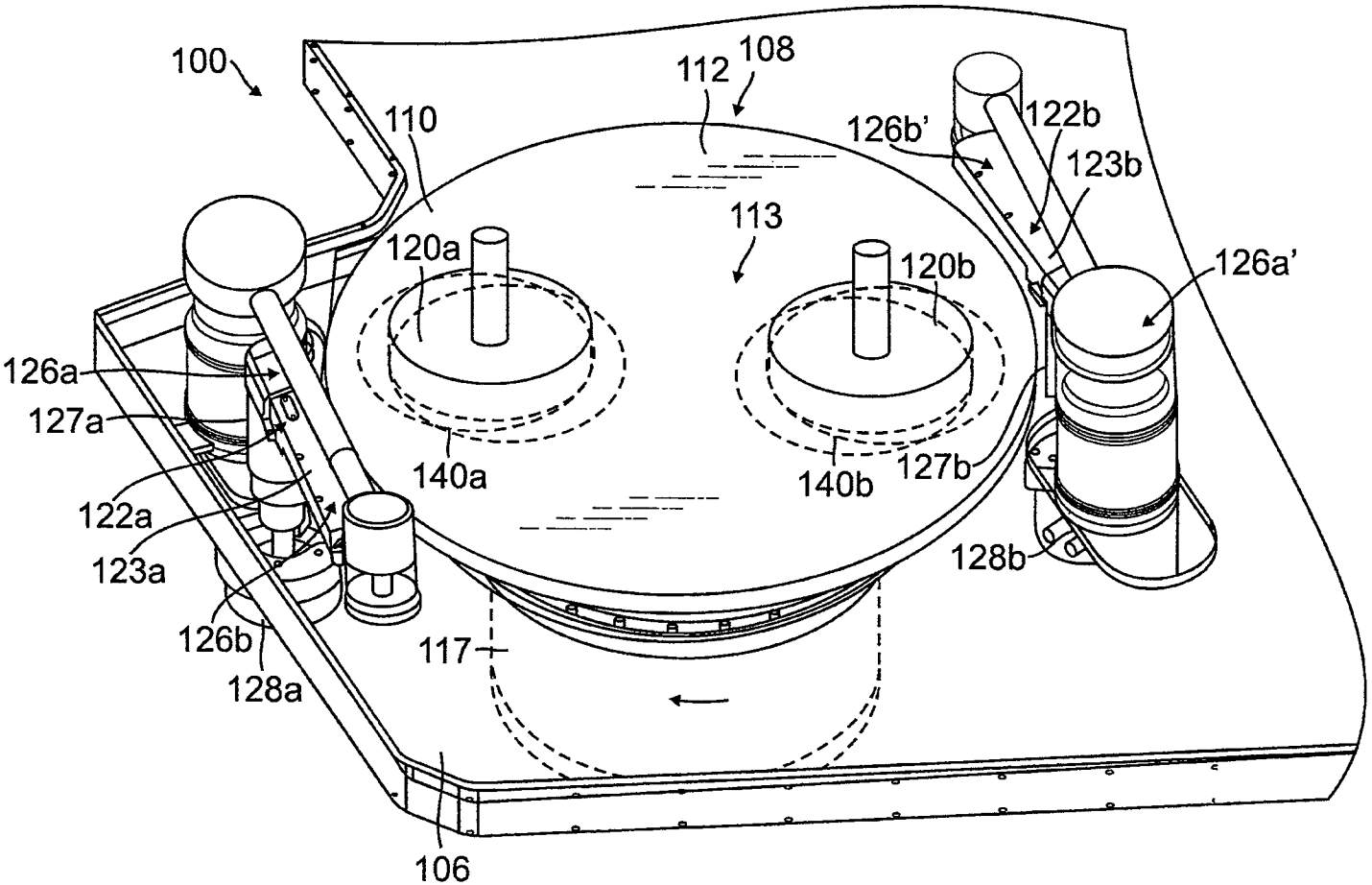
FIG. 1 is a perspective view of a polishing platen assembly comprising a polishing platen, moveable slurry dispenser, and polishing pad conditioner, in the standby position.

An embodiment of a polisher 100 suitable for polishing a surface of a substrate comprising a semiconductor wafer, display, or panel, is shown in FIG. 1. The polisher 100 comprises a tabletop 106 that holds one or more polishing stations 108 that can operate simultaneously and independently. Each polishing station 108 comprises a polishing platen 110 that supports a polishing pad 112. First and second substrate carriers 120*a,b* each press a substrate 140*a,b*, respectively, against the polishing pad 112 while the platen 110 rotates, oscillates or vibrates. In one version, the platen 110 is rotated by a platen motor 117 which is coupled to the underside of the platen 110 with a drive shaft. In one version, the platen motor 117 is a variable speed direct current motor, such as a servomotor, which can selectively provide variable substrate rotation speeds during polishing. The platen 110 can be an aluminum or stainless steel plate.

The polishing pad 112 mounted on the platen 110 typically comprises a planar disc having a radius that is sized sufficiently large to provide coverage for at least two substrates 140*a,b*. The polishing pad 112 contacts and rotates against the substrates 140*a,b* (which can also be rotated, oscillated or vibrated themselves) to polish each substrate 140*a,b*. The polishing pad 112 comprises a polishing surface 113 made of a material that is sufficiently abrasive to polish and remove undesired material from the substrates 140*a,b* without excessively scratching or otherwise damaging the substrate surface. For example, the polishing surface 113 may be made of a polymer, felt, paper, cloth, ceramic, or other such materials. The polishing surface 113 can also include more grooves (not shown) to enhance the flow of the polishing slurry over the polishing surface 113. For example, a suitable polishing pad 112 comprises a fixed abrasive polishing pad, manufactured by 3M Superabrasives and Microfinishing Systems Division, St. Paul, Minn., which contains abrasive particles, such as silica, embedded in a resin. In one version, the polishing pad 112 is adhered to the platen 110, which is about the same diameter as the polishing pad 112, using a pressure sensitive adhesive.

First and second substrate carriers 120*a,b* are each adapted to hold a substrate 140*a,b*, respectively, against the polishing pad 112. The substrates 140*a,b* are held onto each substrate carrier 120*a,b* with a vacuum or surface tension. Each of the substrate carriers 120*a,b* apply a pressure while independently rotating and oscillating back-and-forth across the polishing pad 112 to achieve a uniformly polished surface on the substrates 140*a,b*. During polishing, a pneumatic system (not shown) lowers the substrate carriers 120*a,b* onto the polishing pad 112 to press the substrates 140*a,b* against the polishing pad 112 with a pre-determined loading force. The platen motor 117 rotates the platen 110 and polishing pad 112. At the same time, each substrate carrier 120*a,b* rotates a substrate 140*a,b*, while sliders (not shown) linearly drive the substrate carriers 120*a,b* back and forth to oscillate the substrates 140*a,b* laterally on the surface of the polishing pad 112. The substrate carriers 120*a,b* are driven by one or more carrier motors (not shown), which can also be a variable speed direct current motor, such as a servo-motor, that can provide variable substrate rotational speeds and can also move the substrate in a back and forth linear motion. The substrate carriers 120*a,b* abrade the surface of the substrates 140*a,b* by rubbing the substrates against two different regions of the polishing pad 112.

During, before or after polishing, first and second slurry dispensers 122*a,b* provide polishing slurry, neutralizing solution, and/or water to the surface of the polishing pad 112. In one version, the first and second slurry dispensers 122*a,b* are positioned abutting the polishing platen 110. The dispensers 122*a,b* can also be located across the platen 110 and diametrically opposing one another. The opposing pair of slurry dispensers 122*a,b* are each located so that they can rotate and be positioned between the first and second substrate carriers 120*a,b*. In one version, the dispensers 122*a,b* sweep in an arc across the polishing platen 110 while dispensing slurry. Each slurry dispenser 122*a,b* feeds fresh polishing slurry to a different region of the polishing pad 112 that is located immediately before one of the substrates 140*a,b* mounted on the substrate carriers 120*a,b*. In this manner, the first slurry dispenser 122*a* provides fresh slurry to the substrate 120*b* on the second substrate carrier 120*b* and the second slurry dispenser 122*b* provides fresh slurry to the substrate 120*a* on the first substrate carrier 120*a*, or vice versa, depending on the direction of rotation of the polishing platen 110. Advantageously, this allows the polisher 100 to polish both substrates 148*a,b* at approximately the same polishing rates because fresh polishing slurry is dispensed at different circumferential regions across the polishing pad 112 that each lie between the first and second substrate carriers 120*a,b*.

The first and second slurry dispensers 122*a,b* each comprise a dispenser arm 123*a,b* which has a pivoting end 126*a,a*' and a distal end 126*b,b*', respectively. Each pivoting end 126*a,a*' of the slurry dispenser arms 123*a,b* is mounted on a rotatable axle 127*a,b*. A dispenser drive 128*a,b* powers the rotatable axle 127*a,b* to rotate each dispenser arm 123*a,b* about their pivoting ends 126*a,a*' to swing the respective slurry dispensing nozzles at the distal ends of the arms 123*a,b* to dispense slurry across the polishing platen 110. The dispenser drives 128*a,b* can be operated to rotate the dispenser arms 123*a,b* so that the pivoting ends 126*a,a*' rotates along a fixed arc across different regions of the polishing platen 110. The dispenser drives 128*a,b* are capable of rotating each arm 123*a,b* to sweep each arm in an arc across the polishing platen 110 while dispensing slurry. In one embodiment, each arc covers an arcuate distance that spans from about 0° to about 45°. The first and second fixed arcs can oppose one another across a diameter of the polishing pad 112.

Figure 2:
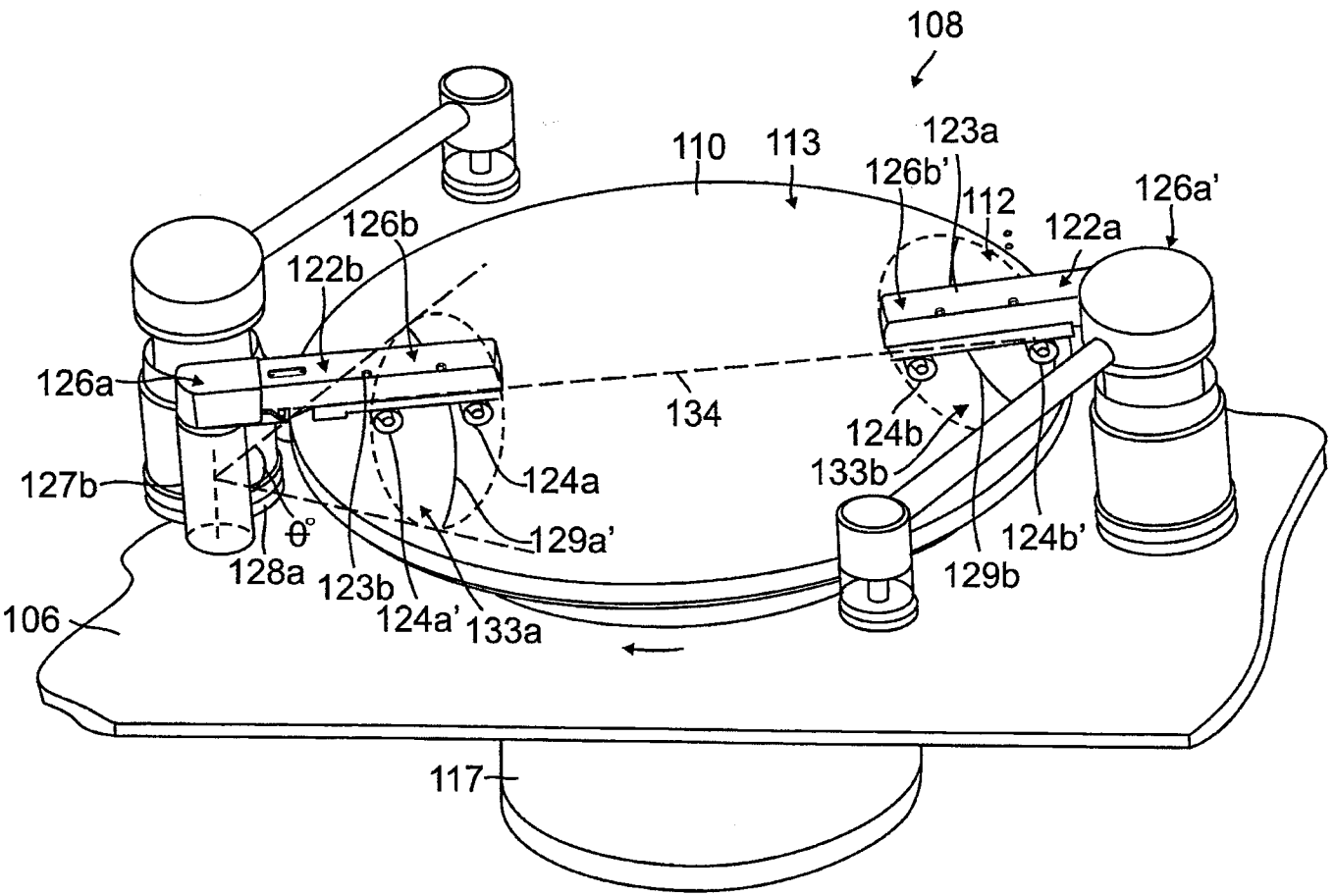
FIG. 2 is a perspective view of the polishing platen assembly of FIG. 1 showing the movable slurry dispenser dispensing polishing slurry onto the polishing pad.

At least one slurry dispensing nozzle 124*a,b* is provided between the pivoting end 126*a,a*' and the distal end 126*b,b*' of each of the dispenser arms 123*a,b*, respectively, as shown in FIG. 2. When a dispenser drive 128*a* rotates a particular dispenser arm 123*a* along an arc, the slurry dispensing nozzle 124*a* is also swung along a fixed arc 129 to distribute the slurry on the polishing pad 112 within the arcuate region 133*a*. The dispenser drives 128*a,b* are each capable of rotating one of the dispenser arms 123*a,b* about the pivoting end 126*a,a*' so that the nozzles 124*a,b* are each swung along a fixed arc 129*a,b*, respectively, that each bisects a fixed radial axis 134 of the platen 110 at least twice when starting from a first position, moving to a second position across the arc, and returning to the same first position. In this manner, the polishing slurry is dispensed by rotating the dispenser arms 123*a,b* about two different pivot points that oppose one another across the polishing pad 112. Thus slurry is dispensed simultaneously from different points that are spaced apart from one other across the polishing pad 112 and that even can be aligned along a common axis which is a particular diameter of the platen. A suitable dispenser drive 128*a,b* can be a motor such as a servomotor with gear reduction or a direct drive motor, or a hydraulic system that can extend and retract to move the dispenser arms 123*a,b*. The first and second arcs can be fixed arcs, and they can also diametrically oppose one another across the polishing platen 110. The arcs lie between the first and second substrate carriers 120*a,b*, and provide fresh polishing slurry to each of the first and second substrate carriers 120*a,b*.

The slurry dispensers 122*a,b* can also comprise at least a first nozzle 124*a,a*' and a second nozzle 124*b',b*', respectively. Each of the first and second nozzles 124*a,a*' and 124*b,b*' are spaced apart from one another, and can also be aligned along a common axis that is along the longitudinal direction of the arms 123*a,b*. The dispensing nozzles 124*a,a*' and 124*b,b*' direct fluid, such as polishing slurry, onto the polishing pad 112 to distribute polishing slurry across a larger surface of the polishing pad 112 in the desired spray coverage area 133*a,b*.

Figure 3:
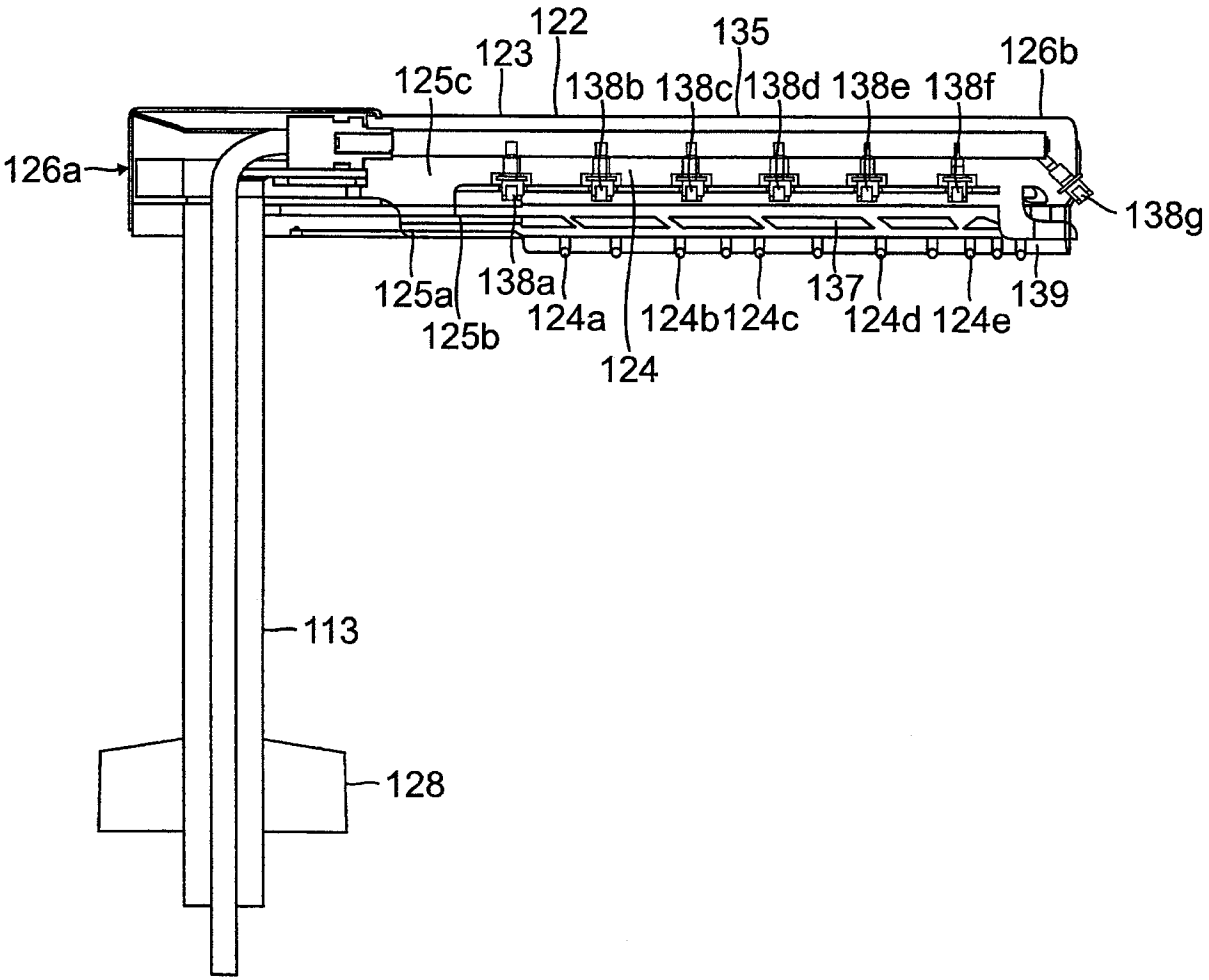
FIG. 3 is a cross sectional side view of an embodiment of a slurry dispenser arm of FIG. 2.

Referring to FIG. 3, the dispenser arm 123 includes a hollow casing 135 that surrounds and protects a plurality of supply tubes 125*a-c* which each provide a passage for polishing slurry, neutralizing fluid, or water, across the length of the dispenser arm 123. For example, the supply tube 125*a* can be used to supply polishing slurry to a barrel reservoir 137 which feeds the nozzles 124*a-e*. Each nozzle 124*a-e* is attached to a supply tube 125*a* by a convenient method. For example, preformed nozzles 124*a-e* can be attached to a fluid supply tube 125*a* using male and female screw threads or with rubber gasket seal. The fluid supply tubes 125*a-c* are made of a material that is resistant to corrosion or chemical reaction by the desired supply fluid, or even comprise a material that is capable of reduced buildup of deposits on the fluid-contacting surfaces. It is further desirable for the fluid supply tube to be flexible, such that it can withstand bending and flexing when the slurry arm is rotated. An exemplary embodiment of a fluid supply tube can be, for example, THV tubing such as THV x50 UHP available from Dyneon, (city, state). Each fluid supply tube 125*a-c* is provided with fluid by a fluid supply source (not shown) located externally to the polisher 100. The fluid supply source can comprise a pressurized tank, chemical delivery unit or drum with pump and can supply slurry, chemical or water. One or more valves, pressure sensors and volumetric flow meters can also be used in between the fluid supply source and the supply arm to control the supply of fluid.

The embodiment of the slurry dispenser 122 shown in FIG. 3, comprises a plurality of nozzles 124*a-e*. Each nozzle 124*a-e* has a terminus opening of from about 0.03" to about 0.05". The nozzles 124*a-e* can also have a cross-section with a conical profile to output pressurized fluid in a conical spray pattern. A suitable conical profile comprises an angular width of from about 40° to about 120°. The nozzles 124*a-e* can be made by drilling holes in a tube made from a material that is resistant to erosion by, and reaction with, the desired polishing slurry composition. The nozzles 124*a-e* can also be formed from material that withstands buildup of deposits on the fluid-contacting surfaces of the nozzles. In one embodiment, the nozzles 124*a-e* are made from PVDF. In an alternative embodiment, the nozzles 124*a-e* are separately made and are attached to the dispenser arm 123 by screw threads or adhesive sealants. An exemplary preformed nozzle 124*a-e* is the VeeJet Spray Nozzle, available from: Spraying Systems Co. (Spraying Systems Co., North Avenue at Schmale Road, Carol Stream, Ill.).

The plurality of nozzles 124*a-e* can also be located in a slurry dispenser channel 137 that is affixed along the length of the dispenser arm 123 to disperse slurry across the polishing pad 112. The dispenser channel 137 comprises a hollow rectangular body that is disposed along the underside of the dispenser arm 123 such that the longitudinal axis of the channel is substantially parallel to the longitudinal axis of the hollow body. The dispenser channel 137 comprises one or more integral slurry dispensing nozzles 124*a-e* that can be formed, for example, by machining or drilling a nozzle shaped opening into the dispenser channel 137. Each shaped opening of the nozzles 124*a-e* can have, for example, a conical profile that tapers outward with a smaller first opening facing the internal volume of the channel 137 and a larger second opening at the exterior surface of the channel 137 (not shown). For example, the shaped opening can have a first opening diameter of less than 1 mm, and a second opening diameter of greater than about 1.1 mm. The shaped opening opens toward the platen surface and comprises a diameter of from about 1 mm to about 2 mm. The first opening of the dispenser channel can also be sufficiently large to fit over the diameter of a corresponding opening of the fluid supply tube 125*a* which supplies polishing slurry to the dispenser channel.

As a substrate 140 and polishing pad 112 are rotated against each other, measured amounts of polishing slurry supplied according to a selected slurry recipe are sprayed onto the polishing pad through the nozzles 124*a-e*. The polishing slurry contains a reactive agent and a chemically reactive catalyst. For example, an oxide substrate can be polished with polishing slurry comprising deionized water—which is used as the reactive agent, and potassium hydroxide—which serves as the catalyst. Suitable polishing slurries may also comprise, for example, abrasive particles comprising at least one of aluminum oxide, silicon oxide, silicon carbide, or other ceramic powders; and which are suspended in a solution comprising for example, one or more of water, alcohol, buffering agents and suspension chemicals.

The dispenser arm 123 of the slurry dispenser 122 also includes a separate set of rinsing nozzles 138*a-g* which provide a rinsing fluid for rinsing a substrate 140 after a polishing process. The rinsing nozzles 138*a-g* are spaced apart form one another, and which can provide a high-pressure fluid rinse of the polishing pad 112 at the end of each polishing and/or conditioning cycle. The rinsing fluid is supplied to the rinsing nozzles 138*a-g* through the supply tube 125*c*. A rinsing fluid such as deionized water can be used to clean a substrate 140 as it passes from one polishing station to another. The rinsing nozzles 138*a-g* can also direct streams of water toward the slowly rotating polishing pad 112 to rinse slurry from the polishing pad surface while a substrate 140 is being transferred back to a holding station. Water can also be supplied to the surface of the polishing pad 112 to rinse particles and chemicals from the pad surface between processing of substrates 140. The rinsing step can be performed after polishing a predetermined number of substrates 140 or at the beginning of the polisher operation as a pretreatment step, at the end of operation to remove reactants from the pad surface or on an as-needed basis to rinse particles and chemicals from the pad surface. The rinsing nozzles 138*a-g* can also comprise conical cross-sections to supply a conical spray section of water or other cleaning fluid to the polishing pad 112. A rinsing fluid shield (not shown) can be used to cover the sides of the rinsing nozzles 138*a-g* to contain the spray of the rinsing fluid over the substrate. The rinsing fluid shield can be made from Teflon®, DuPont de Nemours Co., Delaware.

The dispenser arm 123 of the slurry dispenser 122 can also include a chemical rinse nozzle 139 which disperses a chemical agent across the polishing pad 112 to neutralize the active agent of the polishing slurry after the polishing of one or more substrates 140 is completed. While the chemical rinse nozzle 139 is described as a separate nozzle from the slurry dispensing nozzle 124, it can also be the same nozzle structure. In one embodiment, the chemical rinse nozzle 139 is located at the distal end 126*b* of the dispenser arm 123. The composition of the chemical rinse is selected to stop the reaction of the chemically active components of the polishing slurry with the substrate 140 being polished, and can serve to neutralize the etchant or corrosive properties of the active slurry components. For example, in one embodiment, the chemical rinse comprises an acid or ammonia based neutralizing agent.

Figure 4A:
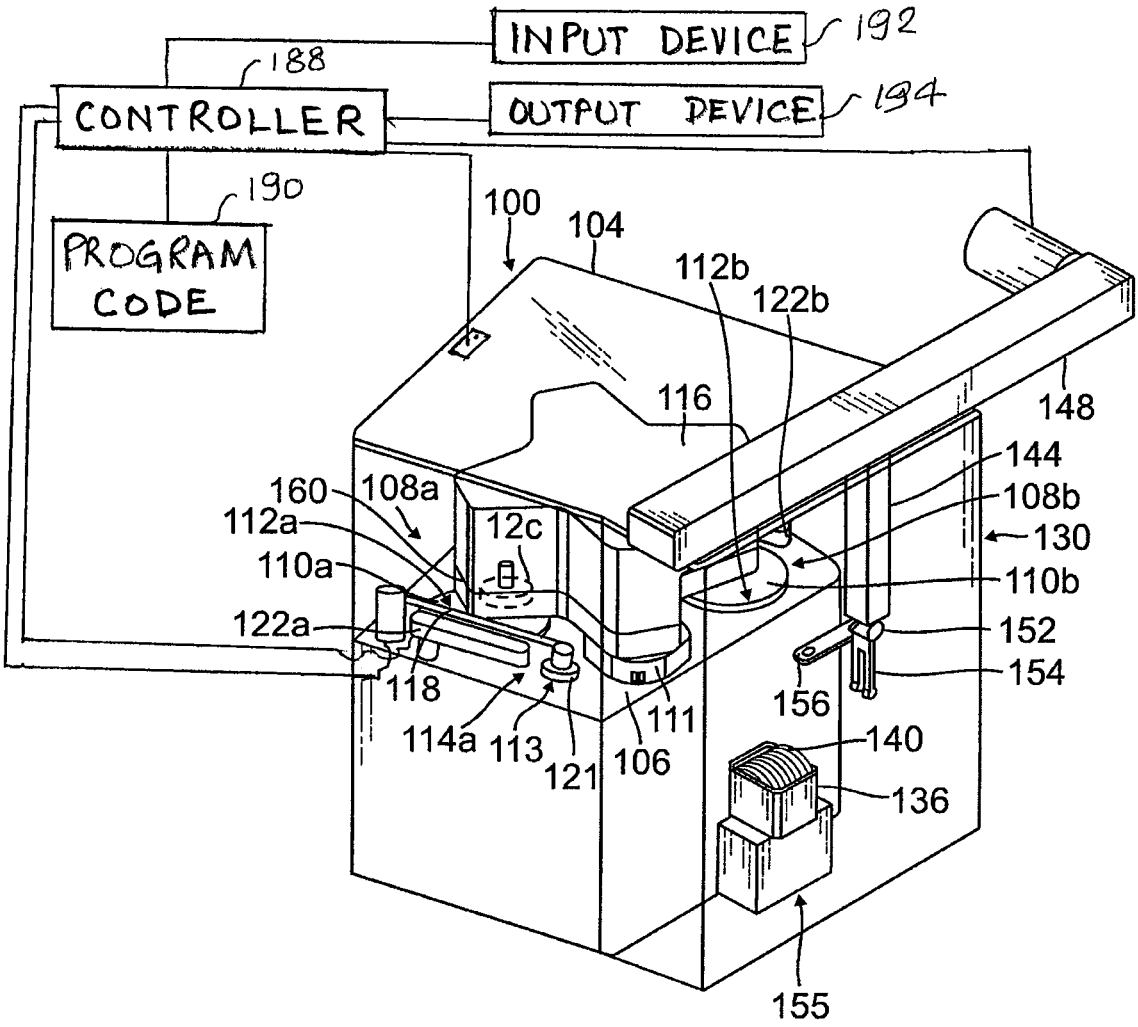
FIG. 4A is a perspective view of an embodiment of a chemical mechanical polisher.

A controller 188 comprises suitable programming code 190 to control the CMP apparatus 100 and its various components, including the slurry dispenser 122, as shown in FIG. 4A. The controller 188 is a programmable computer comprising a CPU, an input device 192 such as a mouse, keyboard, and light pen, and an output device 194 such as a display. The controller 188 is used to calculate and measure polishing parameters and hold recipes for any of the polisher stations 108. In one embodiment, the program code 190 comprises code to control motors of the dispenser arm 123. For example, the code can control a dispenser drive 128 that powers a rotatable axle 127 to rotate each dispenser arm 123 about their pivoting ends 126 to swing the respective slurry dispensing nozzles at the distal ends of the arms 123 to dispense slurry across the polishing pad 112. The controller 188 can operate the motors of the dispenser arm 123 to obtain the desired movement of the arm 123. This movement is controlled to control the motion of the slurry dispensing nozzles 124*a-c* located at the distal end 126 of the arm 123 to dispense slurry onto the polishing pad 112 in a desired pattern or region. For example, the controller 188 can comprise program code to control the motors to move the dispenser arm 123 across the polishing pad 112 to obtain a desired shape of a slurry distribution region across the pad 112.

Figure 5A:
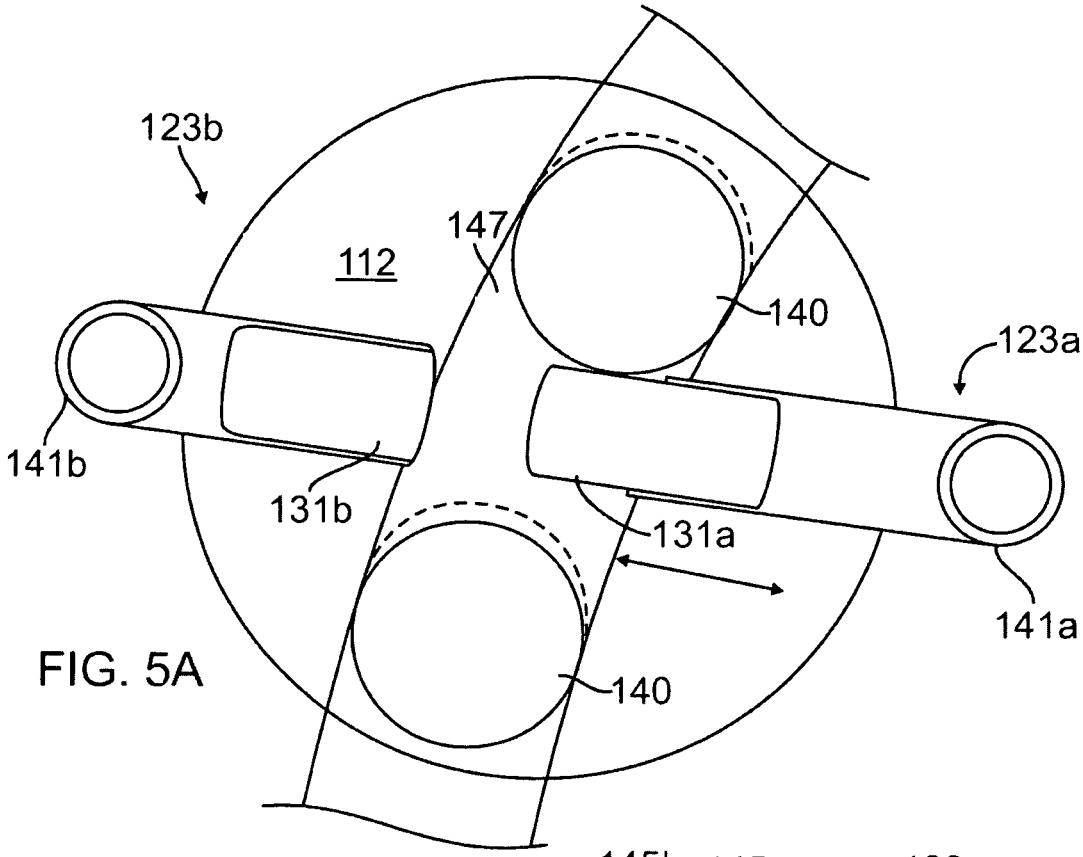
FIG. 5A is a top view of a polishing platen assembly showing another embodiment of a movable slurry dispenser.
Figure 5B:
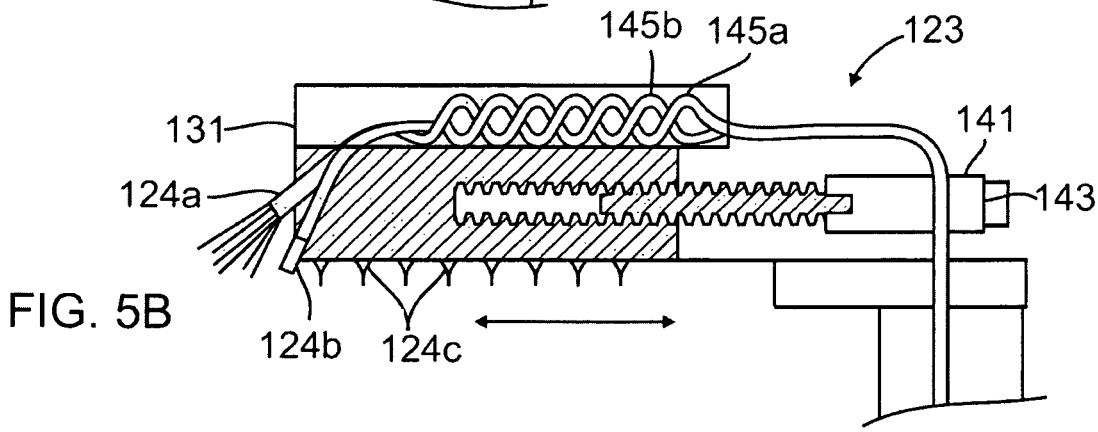
FIG. 5B and FIG. 5C are sectional side and sectional top views of the movable slurry dispenser of FIG. 5A.
Figure 5C:
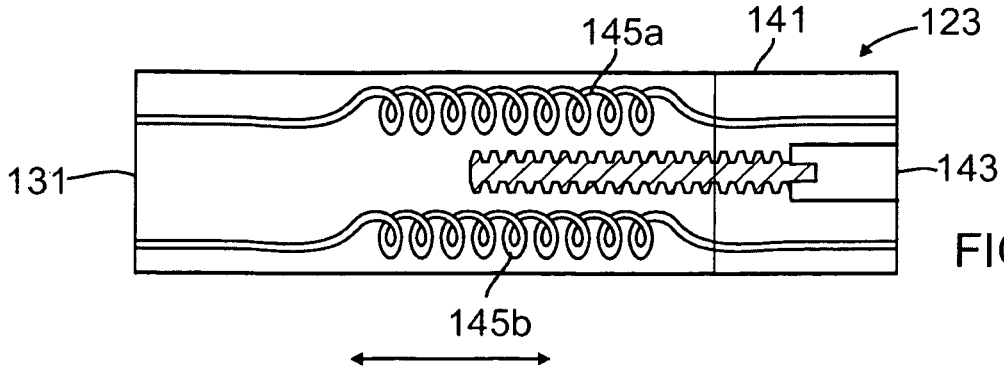

In an alternate embodiment of a slurry dispenser 122, features of which can occur on its own or in combination with any other features described herein, the dispenser arm 123 comprises a distal end 131 that is movable in a linear motion with respect to a proximal end 141, as shown in FIGS. 5A to 5C. The distal end 131 moves linearly with respect to the proximal end 141, for example, in a back and forth sweeping motion. In this manner, the dispensing nozzles 124*a-c* located on the movable segment of the dispenser arm 122 can supply a polishing slurry across a radial length of to the polishing pad 112 to cover a greater surface area of pad.

In this version, the segment of the dispenser arm 123 that includes the distal end 131 is connected to a dispenser drive 143 which can move the distal end 131 towards and away from the proximal end 141 of the dispenser arm 123 along a linear path. The dispenser drive 143 moves the distal end of the arm along a linear path to dispense slurry in a line across the polishing platen. The linear motion can match the line corresponding to the longitudinal axis of the dispenser arm 123. The dispenser drive 143 is controlled by the controller 188, which comprises program code to control the linear motion of the dispenser arm 123. The distal end 131 can travel a linear distance of from about 20% to about 90% of the length of the un-extended dispenser arm 123.

Coiled supply tubes 145*a,b* extend through the length of the dispenser arm 123 to supply polishing slurry, suspension or other fluids to the nozzles 124*a-c*, as shown in FIGS. 5B and 5C. The coiled supply tubes 145*a,b* allow the length of the arm 123 to be altered without altering the supply of fluids to the nozzles 124*a-c*. The coiled supply tubes 145*a,b* can be made of a material that is resistant to corrosion or chemical reaction by the desired supply fluid, or can even comprise a material that is capable of reduced buildup of deposits on the fluid-contacting surfaces. It is further desirable for the fluid supply tube to be flexible, such that it can withstand bending and flexing. The supply tube can be, for example, THV tubing such as THV x50 UHP available from Dyneon. Each coiled supply tube 145*a,b* is provided with fluid by a fluid supply source (not shown) located externally to the polisher 100.

In a prospective embodiment, the controller 188 comprises program code 190 to control the movement of the distal end 131 of the dispenser arm 123 in relation to the movement of a substrate carrier 120. For example, the distal end 131 of the dispenser arm 123 can be moved into position and slurry dispensed to a substrate contact region 147 of the polishing pad 112 immediately prior to contact of this region of the pad, with a substrate 140 held by a substrate carrier 120 (not shown). The distal end 131 of the dispenser arm 123 can be positioned out of the path of the substrate carrier 120 to avoid collision with the carrier assembly. The dispenser arm 123 can supply polishing slurry to a larger area of the polishing pad 112 using a linear sweep that traverses the entire length, or a substantial portion of the radial length, of the platen or pad, as compared to a non-mobile arm.

The linear sweep arm can be configured to supply a polishing slurry along a liner path that traverses from the central region of the polishing pad 112 to the perimeter of the pad. Further, since the nozzles 124*a-c* located about the distal end 131 of the polishing arm 123 can be moved into a radial feeding position above the polishing pad 120, the flow requirements on the polishing slurry are not as stringent. For example, partial clogging of the nozzles 124*a-c* and sputtering of slurry from the dispenser nozzles, which would result in uneven distribution of polishing slurry, does not have as much of an effect because the nozzles 124*a-c* are located closer to the target area and slurry dispensed by the nozzle, however uneven, will still land on the polishing pad 112 in the substrate contact region 147.

The polishing system can comprise first and dispenser arms 123*a*, 123*b* as shown for example in FIG. 5A. First and second dispenser arms 123*a,b* can be configured to oppose one another, for example the proximal end 141*a* of a first dispenser arm 123*a* can be located on the opposite side of the platen from a proximal end 141*b* of a second dispenser arm 123*b*. First and second dispenser arms 123*a,b* can be configured to provide polishing slurry or other fluids to the polishing pad 112 over a larger area than a single dispenser arm 123. Further, opposing first and second dispenser arms can be configured to selectively dispense polishing medium, rinsing fluid, neutralizing chemical fluids or other fluid compositions.

In one prospective embodiment, a first dispenser arm 123*a* is configured to dispense a polishing slurry and a second dispenser arm 123*b* is configured to dispense a rinsing fluid and a neutralizing chemical fluid. In this prospective embodiment the first dispenser arm 123*a* can be removed from the chamber for cleaning of dispenser valves that are clogged with polishing slurry without necessitating removal of the remaining dispenser arm 123*b* or disconnection of the other fluid supply lines.

In another prospective embodiment, a first slurry dispenser and dispenser arm 123*a* is provided to supply polishing slurry or other fluids to a first substrate contact region and a second slurry dispenser and dispenser arm 123*b* is provided to supply polishing slurry or other fluids to a second substrate contact region, the first and second contact regions being different from each other. A first substrate carrier contacts a substrate to the first substrate contact region and a second substrate carrier contacts a substrate to the second substrate contact region. In this manner the first and second slurry dispenser arms 123*a,b* supply slurry to first and second substrate carriers.

Figure 4B:
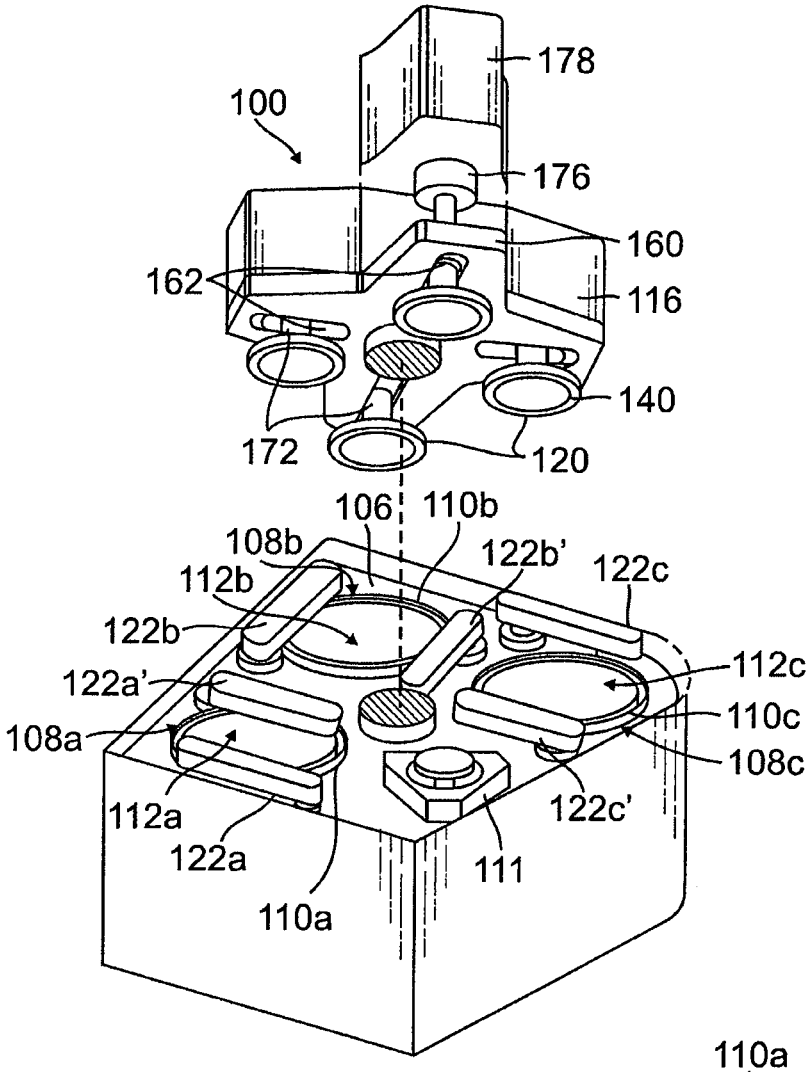
FIG. 4B is a partially exploded perspective view of the polisher of FIG. 4A.
Figure 4C:
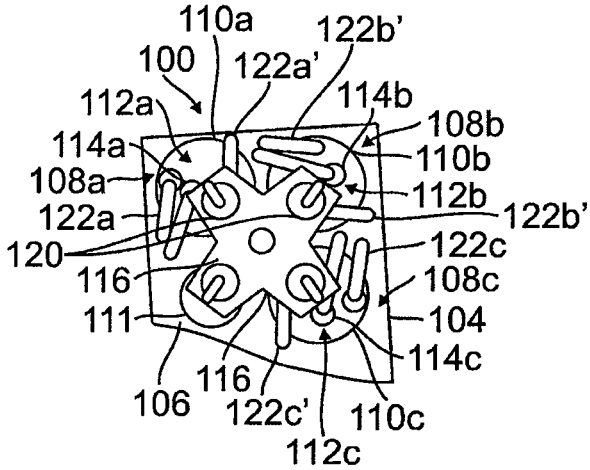
FIG. 4C is a diagrammatic top view of the tabletop of the polisher of FIG. 4A.

The slurry dispensers 122, 122*a,b* described herein can be used in a CMP polisher. One embodiment of a chemical mechanical polisher 100 that can be used to planarize a surface of a semiconductor wafer substrate, is shown in FIGS. 4A to 4C. The polisher 100 is provided to illustrate use of the slurry dispensers 122*a,b*, however, the polisher 100 and other embodiments described herein, should not be used to limit the scope of the present invention. The polisher 100 may be, for example, a Mirra® or Sycamore® type CMP system from Applied Materials, Inc., Santa Clara, Calif. Generally, the polisher 100 includes a housing 104 containing a tabletop 106 one or more polishing stations 108*a,b*, a substrate transfer station 111, and a rotatable multi-head carousel 116 that operates independently rotatable substrate carriers 120, as shown in FIG. 4A. Each polishing station 108*a,b* includes a rotatable polishing platen 110*a,b* having a polishing pad 112*a,b* disposed thereon. The platens 110*a,b* can be a rotatable aluminum or stainless steel plate connected to a platen motor (not shown). The polishing pads 110*a,b* can include fixed-abrasive or non-abrasive pads. The polishing slurry is dispensed onto a pads 112*a,b* by the slurry dispenser 122*a,b*.

Each polishing station 108*a* can also have one or more pad conditioners 114*a* which has a rotatable arm 118 that holds an independently rotating conditioner head 119. The pad conditioner 114*a* maintains the condition of the polishing pad 112*a* to allow the pad to effectively polish the substrates 40. Each pad conditioner head 119 comprises a platen 121 that holds an abrasive disc (not shown). The platen is a support structure, such a carbon steel plate, which provides structural rigidity to the abrasive pad. The abrasive disc comprises an exposed abrasive face of a metal alloy, such as a nickel or cobalt alloy, having abrasive particles embedded in the metal alloy. The polishing stations 108*b* having fixed-abrasive pads do not require a pad conditioner since fixed-abrasive pads generally do not require conditioning. The conditioner head 119 sweeps the abrasive disc across the polishing pad 112 with a reciprocal motion that is synchronized with the motion of the substrate carrier 120 across the polishing pad.

The pad conditioner 114*a* is mounted at a first height from the tabletop 106 that is higher than a second height of the first and second slurry dispensers, as shown in FIG. 1. The first height can be higher than a second height by at least about 15 mm. This version allows the pad conditioner to sweep over the slurry arm, reducing polisher footprint.

Referring back to FIG. 4A, a substrate loading apparatus 130 includes a cassette 136 containing a batch of substrates 140. An arm 144 rides along a linear track 148 and supports a wrist assembly 152, which includes a cassette claw 154 for moving cassettes 136 from a holding station 155 and a substrate blade 156 for transferring substrates 140 from the cassette 136 to the transfer station 111. In operation, a substrate 140 is loaded from the cassette 136 to the transfer station 111, from which the substrate is transferred to a substrate carrier 120 where it is initially held by vacuum. The carousel 116 then transfers the substrate 140 through a series of one or more polishing stations 108*a,b* and finally returns the polished substrate to the transfer station 111. The carousel 116 has a support plate 160 with slots 162 through which the shafts 172 of the substrate carriers 120 extend, as shown in FIG. 7B. The substrate carriers 120 can independently rotate and oscillate back-and-forth in the slots 162 to achieve a uniformly polished substrate surface. The substrate carriers 120 are rotated by respective motors 176, which are normally hidden behind removable sidewalls 178 of the carousel 116.

As shown in FIGS. 4B and 4C, each polishing station 108*a-c* includes a rotatable platen 110*a-c* that each support a polishing pad 112*a-c* having an overhead pair of opposing slurry dispensers 122*a-c*, 122*a'-c'*, respectively. While the slurry dispensers 122*a-c*, 122*a'-c'*, are shown, it should be understood that the slurry dispensers 122*x* can be used instead, or in combination. During polishing, each substrate carrier 120 holds, rotates, and presses a substrate 140 against a polishing pad 112*a-c* affixed to the rotating polishing platen 110*a-c*. As a substrate 140 and polishing pad 112*a-c* are rotated against each other, measured amounts of a polishing slurry of, for example, deionized water with colloidal silica or alumina, are supplied according to a selected slurry recipe, by the polishing slurry dispensers 122*a-c*, 122*a'-c'*. Both the platen 110 and the substrate carriers 120 can be programmed to rotate at different rotational speeds and directions according to a process recipe. For visual clarity, the pad conditioners are not shown in FIG. 4B, whereas three pad conditioners 114*a-c* are shown in FIG. 4C. There can also be six pad conditioners 114 (not shown) each of which is mounted over a slurry dispenser 122*a-c*, 122*a'-c'*, as for example illustrated in FIG. 1.

The present invention has been described with reference to certain preferred versions thereof; however, other versions are possible. For example, the pad conditioner can be used in other types of applications, as would be apparent to one of ordinary skill, for example, as a sanding surface. Other configurations of the CMP polisher can also be used. Furthermore, alternative channel configurations equivalent to those described can also be used in accordance with the parameters of the described implementation, as would be apparent to one of ordinary skill. Therefore, the spirit and scope of the appended claims should not be limited to the description of the preferred versions contained herein.

What is claimed is:

1. A chemical mechanical polisher comprising:

(a) a polishing platen capable of supporting a polishing pad;

(b) first and second substrate carriers that are each capable of holding a substrate against the polishing pad; and (c) first and second slurry dispensers that are each positioned to lie between the first and second substrate carriers while also opposing one another across the polishing platen when dispensing slurry, each slurry dispenser comprising:

(i) an arm comprising a pivoting end and a distal end;

(ii) at least one slurry dispensing nozzle on the distal end; and (iii) a dispenser drive capable of rotating the arm about the pivoting end to swing the slurry dispensing nozzle at the distal end to dispense slurry across the polishing platen.

2. A polisher according to claim 1 wherein the dispenser drive is capable of rotating the arm to sweep the arm in an arc across the polishing platen while dispensing slurry.

3. A polisher according to claim 1 wherein the first and second slurry dispensers diametrically oppose one another across the polishing platen.

4. A polisher according to claim 1 wherein the first and second slurry dispensers rotate to be positioned between the first and second substrate carriers to provide fresh slurry to one of the first or second substrate carriers.

5. A polisher according to claim 1 wherein the dispenser drive rotates the arm so that the slurry dispensing nozzle is swept along a fixed arc that lies between the first and second substrate carriers and does not contact either of the substrate carriers.

6. A polisher according to claim 5 wherein the fixed arc bisects a radial axis of the polishing pad at least twice.

7. A polisher according to claim 1 wherein the dispenser drive is programmed to rotate the arm along a fixed arc of from about 0° to about 45°.

8. A polisher according to claim 1 wherein the first and second slurry dispensers each comprise a plurality of slurry dispensing nozzles that are spaced apart from one other.

9. A polisher according to claim 8 wherein the slurry dispensing nozzles are aligned along a common axis.

10. A polisher according to claim 1 further comprising first and second pad conditioners that are mounted at a first height from the tabletop that is higher than a second height of the first and second slurry dispensers.

11. A chemical mechanical polishing method comprising:

(a) rubbing first and second substrates against a polishing pad; and (b) dispensing polishing slurry along first and second fixed arcs before each of the first and second substrates, the first and second fixed arcs opposing one another across a diameter of the polishing pad.

12. A method according to claim 11 wherein the first and second fixed arcs are spaced apart and each lie between the first and the second substrate carriers.

13. A method according to claim 11 wherein each of the first and second fixed arcs are at different positions and between the first and second substrates.

14. A method according to claim 11 wherein the first and second fixed arcs bisect a radial axis of the polishing pad at least twice.

15. A method according to claim 11 wherein each of the first and second fixed arcs is from about 0° to about 45°.

16. A method according to claim 11 comprising dispensing slurry simultaneously from different points that are spaced apart from one other and aligned along a common axis.

17. A chemical mechanical polisher comprising:

(a) a polishing platen capable of supporting a polishing pad;

(b) first and second substrate carriers that are each capable of holding a substrate against the polishing pad; and (c) first and second slurry dispensers that abut the polishing platen and when dispensing slurry, diametrically oppose one another across the polishing platen such that each of the first and second slurry dispensers lies between the first and second substrate carriers, each slurry dispenser comprising:

(i) an arm comprising a pivoting end and a distal end;

(ii) at least one slurry dispensing nozzle on the distal end; and (iii) a dispenser drive to rotate the arm about the pivoting end to swing the slurry dispensing nozzle at the distal end along a fixed arc that allows slurry to be dispensed along an arc across the polishing pad, wherein the first and second slurry dispensers rotate such that each arm and slurry dispensing nozzle lie between a first and a second substrate carrier to provide fresh slurry to each of the first and second substrate carriers.

18. A polisher according to claim 17 wherein the dispenser drive rotates the arm so that the slurry dispensing nozzle is swept along a fixed arc that bisects a radial axis of the polishing pad at least twice.

19. A chemical mechanical polisher comprising:

(a) a polishing platen capable of supporting a polishing pad;

(b) first and second substrate carriers that are each capable of holding a substrate against the polishing pad; and (c) first and second slurry dispensers positioned opposing one another across the polishing platen when dispensing slurry, each slurry dispenser comprising:

(i) an arm comprising a proximal end and a distal end;

(ii) at least one slurry dispensing nozzle on the distal end; and (iii) a dispenser drive capable of moving the distal end of the arm along a linear path to dispense slurry in a line across the polishing platen.

20. A polisher according to claim 19 wherein the first and second slurry dispensers are across the polishing platen.

21. A polisher according to claim 19 wherein the dispenser drive is capable of moving the distal end toward or away from the proximal end.

22. A polisher according to claim 19 wherein the dispenser drive is capable of moving the distal end along a line that corresponds to the longitudinal axis of the arm.

23. A polisher according to claim 19 wherein the dispenser drive is controlled by program code of the controller.

24. A polisher according to claim 19 wherein the distal end of the arm moves across a distance of from about 20% to about 90% of the length of the un-extended arm.

25. A polisher according to claim 19 comprising a coiled supply tube that extend through the length of the arm to supply polishing slurry, suspension or other fluids to the dispensing nozzle.

26. A polisher according to claim 19 wherein the first and second slurry dispensers diametrically oppose one another across the polishing platen.

* * * * *

UNITED STATES PATENT AND TRADEMARK OFFICE

CERTIFICATE OF CORRECTION

PATENT NO. : 8,414,357 B2
APPLICATION NO. : 12/196860
DATED : April 9, 2013
INVENTOR(S) : Wang et al.

It is certified that error appears in the above-identified patent and that said Letters Patent is hereby corrected as shown below:

In the Claims:

Column 12, line 33, "extend" should be changed to --extends--.

Signed and Sealed this
Eighteenth Day of June, 2013

Teresa Stanek Rea
*Acting Director of the United States Patent and Trademark Office*